United States Patent [19]

Fitzgerald

[11] 4,192,511

[45] Mar. 11, 1980

[54] PORTABLE MINIATURE GOLF GAME

[76] Inventor: Denis E. Fitzgerald, 212 S. Kamloops St., Vancouver, British Columbia, Canada, V5K 3T9

[21] Appl. No.: 967,191

[22] Filed: Dec. 7, 1978

[51] Int. Cl.[2] ..... A63B 69/36

[52] U.S. Cl. ..... 273/176 G; 273/176 J; 273/208

[58] Field of Search ..... 273/176 F, 176 FA, 176 FB, 273/176 G, 176 H, 176 J, 181 R, 181 A, 198, 195 R, 208

[56] References Cited

U.S. PATENT DOCUMENTS

| | | | |
|---|---|---|---|
| 1,870,536 | 8/1932 | Vaccaro | 273/176 G |
| 1,923,152 | 8/1933 | Kohn | 273/181 A |
| 3,578,333 | 5/1971 | Elesh | 273/181 R X |
| 3,897,067 | 7/1975 | Smith | 273/176 H X |
| 4,098,507 | 7/1978 | Hudon | 273/176 H X |

*Primary Examiner*—George J. Marlo
*Attorney, Agent, or Firm*—Townsend and Townsend

[57] ABSTRACT

A portable folding golf game comprises a flat, flexible putting surface with a circular central fairway. A plurality of elongate fairways extend outwards from the central fairway. There is a plurality of circular greens, one green at the end of each fairway. Each green has a central aperture for receiving a golf ball. A flat teeing surface has a golf tee extending upwardly therefrom and a bridle for connecting the teeing surface to the putting surface. A peripheral barrier surrounds the putting surface. The barrier has gaps between the central fairway and the elongate fairways and between the elongate fairways and the greens to permit folding of the golf game. A plurality of detachable barrier extensions bridge the gaps in the peripheral barrier when the game is in use.

11 Claims, 2 Drawing Figures

PORTABLE MINIATURE GOLF GAME

BACKGROUND OF THE INVENTION

This invention relates to a portable miniature golf game.

There have been various attempts in the past to provide portable or miniature golf games, for example, U.S. Pat. Nos. 3,897,067 to Smith; 2,766,048 to Fortino; 3,909,006 to Arbaugh; 2,701,140 to Fortino; 3,434,720 to Hall; and 2,606,028 to Zion.

Of these patents, U.S. Pat. No. 3,897,067 to Smith discloses a portable golf course for indoor or outdoor use which may be disassembled for portability. Smith achieves his portability by providing a plurality of rigid components interconnected hingedly by pins. There is no provision for realistic playing surfaces similar to grass and the slits in the surface between individual components prevent accurate putting. Moreover, Smith is only a putting game, there being no equivalent to the part of a full scale golf game where the ball is driven from the tee to the green.

SUMMARY OF THE INVENTION

According to the present invention, a portable folding golf game comprises a flat, flexible putting surface with a circular center fairway. A plurality of elongate fairways extends radially outwards from the central fairway and a plurality of circular greens, one green at the end of each fairway, each green having a central aperture for receiving a golf ball. A teeing means comprises a flat teeing surface with a golf tee extending upwardly therefrom and bridle means for connecting the teeing surface to the putting surface. A peripheral barrier surrounds the putting surface. The barrier has gaps between the central fairway and the elongate fairways and between the elongate fairways and the greens to permit folding of the golf game. A plurality of detachable barrier extensions bridge the gap in the peripheral barrier when the game is in use.

When compared with the prior art, the golf game according to the invention has the advantage of providing a putting surface which may be made essentially continuous from a material, such as indoor-outdoor carpeting, which resembles as closely as possible the actual putting surface of a golf green. Because the putting surface is flexible, it is particularly useful for outdoor use on ground which may be irregular. Games such as disclosed by Smith in U.S. Pat. No. 3,897,067 are not so adaptable for outdoor use. Because the teeing surface is connected to the putting surface by the bridle, the flexibility of the game is increased and the ball may be driven through the air from the tee to the central fairway. The peripheral barrier surrounding the entire putting surface prevents the ball from rolling off the golf game. Smith has no such equivalent feature. The gaps in the barrier and the plurality of detachable barrier extensions allow the game to be folded while providing this continuous barrier for the balls. The use of raised mounds surrounding the central aperture of the greens permits the game to rest directly on a surface without requiring legs or other such supports as found in Smith.

In the drawings:

FIG. 1 is an isometric view of a portable folding game according to an embodiment of the invention; and FIG. 2 is a sectional view through a green of the game taken along line 2—2 of FIG. 1.

DESCRIPTION OF THE PREFERRED EMBODIMENTS

Figure 1:
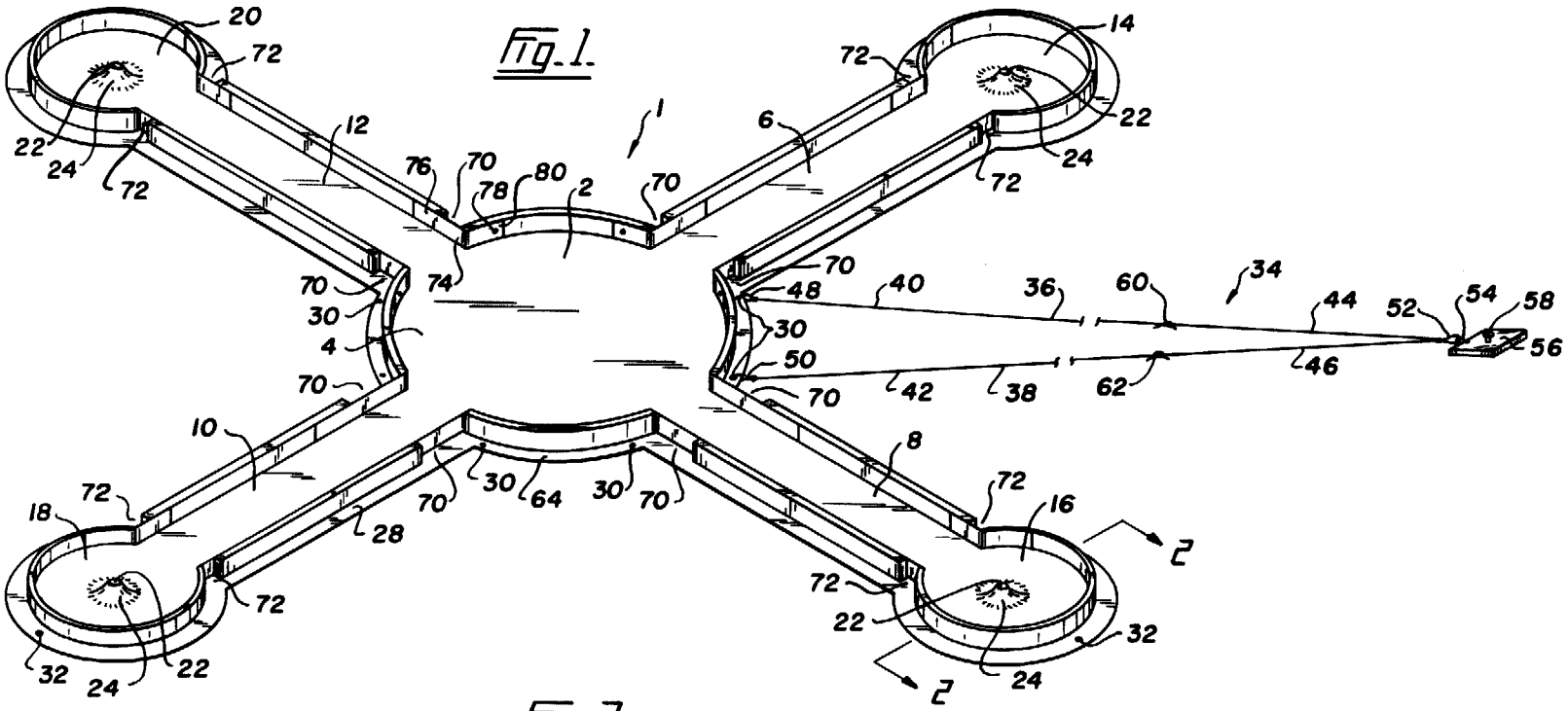
Figure 2:
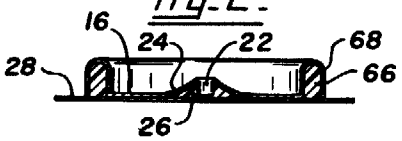

The embodiment of the invention shown in the drawings comprises a portable folding golf game 1 with a flat, flexible putting surface 2. The putting surface 2 is cruciform in shape with a circular central fairway 4 and four elongate fairways 6, 8, 10 and 12 extending radially outwards therefrom. Four circular greens 14, 16, 18, and 20 are located at the ends of fairways 6 to 12 respectively. The putting surface 2 preferably comprises a single piece of the short pile carpeting commonly known as indoor-outdoor carpeting. However, because of the considerable wastage of carpeting that this would involve, several pieces of carpeting can be used. For example, central fairway 4, elongate fairways 6, 8, 10 and 12 and greens 14, 16, 18 and 20 could all comprise separate pieces of carpeting closely butted together with the lower unexposed surfaces taped together with a suitable carpeting tape. Foam backed carpeting is used for central fairway 4 to provide a suitably resilient surface.

Each of the greens 14 to 16 has a central plastic cup 22 comprising an aperture for receiving a golf ball. A raised mound 24 surrounds each cup 22 and comprises a truncated cone 26 under the putting surfaces 2. The truncated cone 26 is preferably a resilient plastic foam or, possibly, cork.

The putting surface 2 is provided with a backing 28 which extends beyond the putting surface to provide a border of approximately 2 inches. The backing 28 is preferably of a waterproof flexible sheet of canvas, a similar fabric or plastic. A pair of approximately one inch grommets 30 are fitted to the backing 28 at spaced-apart points on the border of the backing and between each of the elongate fairways. Four additional grommets 32 are fitted to the backing 28 outside the greens near the extreme ends of the game. Pegs may be driven through grommets 32 to hold the game down for outdoor use or weights may be tied to these grommets to hold the game in place during indoor use.

Grommets 30 are used to attach a bridle 34. The bridle 34 has two portions 36 and 38 with first ends 40 and 42 and second ends 44 and 46 respectively. The first ends are provided with safety hooks 48 and 50 for connecting the bridle to the grommets 30. The second ends of the two portions are connected together and are fitted with a single safety hook 52 for connecting the bridle to the ring 54 connected to teeing surface 56. Teeing surface 56 is of a suitable material such as plywood and is fitted with a part of a standard golf tee 58 extending upwardly therefrom. Bridle portions 36 and 38 are fitted with buckles 60 and 62 respectively to adjust the distance between tee 58 and the central fairway 4.

The putting surface 2 is surrounded by a peripheral barrier or curb 64 which comprises a resilient foam plastic core 66 and a canvas covering 68. The peripheral barrier 64 is provided with gaps 70 between the central fairway 4 and each of the elongate fairways 6, 8, 10 and 12. Similar gaps 72 are provided between each of the elongate fairways and the corresponding greens 14, 16, 18 and 20. These gaps are required to permit easy folding of the game. At each of the gaps, the game is provided with a detachable tab or barrier extension 74. These tabs are of a flexible material such as canvas.

They are fixedly connected to the barrier at their first ends 76. The second ends 80 of the tabs and the barrier are fitted with corresponding snap fastener portions 78 for detachably connecting the second ends to the barrier. Each of the tabs 74 spans one of the sixteen gaps in the barrier.

If desired, each of the greens 14, 16, 18 and 20 may be marked with a different color and four golf balls of the same colors may be used in the game. Each player plays to the green corresponding in color to the color of his ball.

The game is designed to accommodate 1 to 4 players. The player selects a ball, tees off to the central circular fairway 4 and then holes out to the green 14, 16, 18 or 20 color-coded to this ball. Of course, numbers may be used instead of colors to designate the correct starting green. The game uses standard golf putting irons for each player and a pitching wedge which is used in common. The remaining equipment, including scoring cards, rules and golf balls, except for their color, are standard golfing items.

Once each player sinks his ball in the hole 22 of his starting green, he returns to his tee and plays the remaining greens successively following a clockwise direction.

The bridle 34 is designed to restrict the distance between the tee 58 and the central fairway 4 during play. The buckles 60 and 62 may be used to decrease the distance as desired.

In order to fold the game, each of the snap fasteners 78 on the tabs 74 is detached from the peripheral barrier. Two opposite greens 14, 16, 18 or 20 are then folded under the two corresponding elongate fairways 6, 8, 10, or 12. The corresponding elongate fairways can then be folded inwardly over the central fairway 4. The entire game is then inverted and the folding steps are repeated for the remaining two greens and fairways. The bridle is wrapped about the central fairway and folded elongate fairways and greens. The safety hooks 52 on the end of the bridle can be secured to an appropriate grommet 30. The bridle then serves as a convenient carrying handle for the game.

What I claim is:

1. A portable folding golf game comprising:

a flat, flexible putting surface with a circular central fairway, a plurality of elongate fairways extending radially outwards from the central fairway and a plurality of circular greens, one green at the end of each fairway, each green having a central aperture for receiving a golf ball;

a teeing means comprising a flat teeing surface with a golf tee extending upwardly therefrom and bridle means for connecting the teeing surface to the putting surface;

a peripheral barrier surrounding the putting surface, the barrier having gaps between the central fairway and the elongate fairways and between the elongate fairways and the greens to permit folding of the golf game; and a plurality of detachable barrier extensions for bridging the gaps in the peripheral barrier when the game is in use.

2. A golf game as claimed in claim 1, the putting surface comprising short pile carpeting.

3. A golf game as claimed in claim 2, the putting surface comprising a canvas backing for the carpeting.

4. A golf game as claimed in claim 2, the greens comprising raised mounds surrounding the central aperture.

5. A golf game as claimed in claim 4, the raised mounds comprising truncated conical portions.

6. A golf game as claimed in claim 5, the truncated conical portions comprising resilient plastic foam.

7. A golf game as claimed in claim 4, the conical portions comprising cork.

8. A golf game as claimed in claim 1, the peripheral barrier comprising resilient plastic foam covered with canvas.

9. A golf game as claimed in claim 1, the barrier extensions comprising tabs fixedly connected to the barrier at first ends, second ends of the tabs and the barrier having corresponding snap fastener portions for detachably connecting the second ends to the barrier.

10. A golf game as claimed in claim 1, the bridle means comprising two bridle portions connected to the teeing surface at first ends and connected to spaced-apart points on the central fairway at second ends.

11. A golf game as claimed in claim 1, the putting surface being cruciform in shape with four elongate fairways and greens.

* * * * *